United States Patent [19]

Fyler

[11] Patent Number: 4,858,906

[45] Date of Patent: Aug. 22, 1989

[54] METHOD AND APPARATUS FOR MANIPULATING AND TRANSPORTING LIMP MATERIAL

[75] Inventor: Donald C. Fyler, Cambridge, Mass.

[73] Assignee: The Charles Stark Draper Laboratory, Inc., Cambridge, Mass.

[21] Appl. No.: 171,265

[22] Filed: Mar. 21, 1988

[51] Int. Cl.[4] ..... B65H 3/08; B65H 3/32; B65H 5/12

[52] U.S. Cl. ..... 271/19; 271/268; 271/95; 112/121.12

[58] Field of Search ..... 271/1, 9, 10, 18.3, 271/19, 24, 25, 268, 95, 147; 901/30; 414/736; 112/121.12, 121.15, 121.29

[56] References Cited

U.S. PATENT DOCUMENTS

| | | | |
|---|---|---|---|
| 3,588,091 | 6/1971 | Stone et al. | 271/19 |
| 3,856,294 | 12/1974 | Lutts et al. | 271/19 |
| 4,312,281 | 1/1982 | Doyen et al. | 112/121 |
| 4,451,191 | 5/1984 | Torre | 271/147 |
| 4,565,362 | 1/1986 | Wiley | 271/268 |
| 4,605,216 | 8/1986 | DeWitt et al. | 271/18.3 |
| 4,632,046 | 12/1986 | Barrett et al. | 112/121 |
| 4,638,749 | 1/1987 | Wood | 112/121 |
| 4,641,827 | 2/1987 | Walton et al. | 271/18 |
| 4,645,193 | 2/1987 | Walton et al. | 271/18 |
| 4,768,451 | 9/1988 | Spencer, III | 112/121.12 |

FOREIGN PATENT DOCUMENTS 1191456 5/1970 United Kingdom .

*Primary Examiner*—Joseph J. Rolla
*Assistant Examiner*—Mona C. Beggle
*Attorney, Agent, or Firm*—Lahive & Cockfield

[57] ABSTRACT

An automated system for selectively providing a limp material segment, e.g., fabric, to a joining apparatus includes at least one picker actuation mechanism ("PAM") for manipulating and transporting the segment. The PAM has an end effector for picking up the segment and an independently operable clamp for holding the segment while the PAM itself is transported between work stations.

9 Claims, 7 Drawing Sheets

METHOD AND APPARATUS FOR MANIPULATING AND TRANSPORTING LIMP MATERIAL

REFERENCE TO RELATED PATENT

The subject matter of this application is related to that of U.S. Pat. No. 4,632,046, entitled "Assembly System for Seamed Articles", U.S. Pat. No. 4,401,044, entitled "System and Method for Manufacturing Seamed Articles", U.S. Pat. No. 4,457,243, entitled "Automated Seam Joining Apparatus", U.S. Pat. No. 4,512,269, entitled "Automated Assembly System for Seamed Articles", and U.S. Pat. No. 4,638,749, entitled "Automated System For Sequentially Loading Lowermost Segments From A Shingled Stack Of Limp Material Segments".

BACKGROUND OF THE INVENTION

This invention relates to systems for automated or computer-controlled assembly of seamed articles from limp material, e.g., fabric. In particular, this invention relates to a system for automatically loading limp material segments for assembly by an automated assembly device.

Conventionally, assembly line manufacture of seamed articles constructed of limp fabric has incorporated a series of manually controlled assembly operations. Tactile presentation of the fabric-to-be-joined is made to the joining or sewing head under manual control. One drawback of this assembly technique is that the technique is labor intensive; that is, a large portion of the cost for manufacture is attributable to labor. To reduce labor cost, automated or computer-controlled manufacturing techniques have been proposed in the prior art.

The above-referenced patents disclose a set of assembly-related techniques that are readily adapted for, or particularly useful in the automated assembly of seamed articles from limp material. In particular, U.S. Pat. No. 4,632,046 discloses an automated seamed garment assembly system which is adapted to receive segments of limp material at a loading table, to automatically transport the segments to a folding station where they are folded with seams aligned, and finally to present the folded segments to a seam forming apparatus where the seams are joined, all under machine control.

In the garment assembly field, the limp material segments for an article are generally pre-cut in batches, and stacks of similarly shaped pairs of elements-to-be-joined are formed. With the prior art manual assembly techniques, human operators generally select the pairs of elements-to-be-joined and manually control the assembly for the selected pairs. Even for the prior art automated assembly devices, such as that disclosed in the above-referenced U.S. Pat. No. 4,632,046, the actual transfer or loading of the limp material segments is generally accomplished manually, for example, by an operator who one-at-a-time loads pairs of elements-to-be-joined onto the receiving or loading table.

While this manual loading approach is effective, due to human abilities to sort by visual characteristics and to perform manual alignments, a relatively high level of skill is required to accomplish the one pair at a time manual loading. Moreover, this manual loading results in the relatively inefficient use of human operators since one has to be standing by on a continuous basis to repetitiously perform the loading in step with the assembly throughput characteristics of the automated article assembly system.

A further automated loading approach is described in the above-referenced U.S. Pat. No. 4,638,749. In that patent, a system for selectively loading the lower-most segment of a shingled stack of limp material segments is described. Each segment includes one or more adjacent layers of the limp material. The system includes a planar surface for supporting the stack in a selected position. A selectively operable extractor transports the lowest-most segment away from the stack. The extractor has one or more sets of hinged jaws adapted to selectively grip a portion of the leading edge of the lower-most segment and, then, transport the segment. Even with this automated system configuration, the shingled stack must be established from a plurality of pre-cut segments.

It is an object of the present invention to provide an improved system for automatically manipulating and transporting limp material.

Another object is to provide an improved automated assembly system for seamed articles including an automatic loading arrangement for use with an automated seamed article assembly system.

Yet another object is to provide an automated system for separating and transporting selected segments from a stack of segments of limp material.

SUMMARY OF THE INVENTION

The invention encompasses an automated system which may be used for selectively providing a segment from a stack of limp material segments to a joining apparatus. In one instance the invention is employed for transporting and manipulating (e.g., separating, picking-up, holding, folding-over, dropping-off) segments of fabric to be loaded into a sewing operation. Each segment includes one or more plies or layers of the limp material. The automated system includes one or more picker actuation mechanisms ("PAM's") for manipulating the segment.

Each PAM has a body with a base plate, a Picker such as a robotic end effector (e.g., an opposing-jaw gripper) for holding and picking up a selected segment, and a picker positioning assembly for supporting and positioning the picker with respect to the base plate. The picker positioning assembly includes articulated linkage preferably arranged in a closed multiple link arrangement pivotally connected between the PAM body and the picker and movable by an actuator between a segment pick-up position at which the picker extends beyond the base plate and a segment release position at which the picker is proximate the base plate. Each PAM also includes a clamp for receiving the selected segment from the picker when at its segment release Position, and for clamping the selected segment with respect to the base plate.

The PAM's are designed to be mounted on a loading apparatus which is adapted for global translation of the PAM's and the segments held thereby. In a rectilinear arrangement, the transport apparatus moves the PAM's vertically and horizontally with respect to a stack of segments. Where the loading apparatus incorporates more than one PAM, the PAM's are preferably operated in synchronization. The operation of the PAM or PAM's as well as the loading apparatus is controlled in any desired sequence by a computer.

The invention embraces the automated system as well as the method of operating the system. An exemplary sequence of manipulating the limp fabric by the PAM optionally includes the steps of picking-up a selected segment from the top of a stack of limp material segments and then folding the selected segment onto itself prior to clamping; thereafter, this process may be repeated for one or more additional segments from the stack.

In other forms, the stack of segments may be replaced with a single elongated segment, e.g. as might extend from the end of a roll of fabric. In the latter form, the PAM may selectively lift a portion of the segment and clamp it; subsequently the PAM may lift an upstream portion of the segment and clamp that latter portion adjacent to the first. Other sequences of operation will be apparent to one skilled in the art to satisfy the needs of particular applications of the invention.

BRIEF DESCRIPTION OF THE DRAWINGS

The foregoing and other objects of this invention, the various features thereof, as well as the invention itself, may be more fully understood from the following description when read together with the accompanying drawings in which.

DETAILED DESCRIPTION OF THE PREFERRED EMBODIMENT

Figure 1:
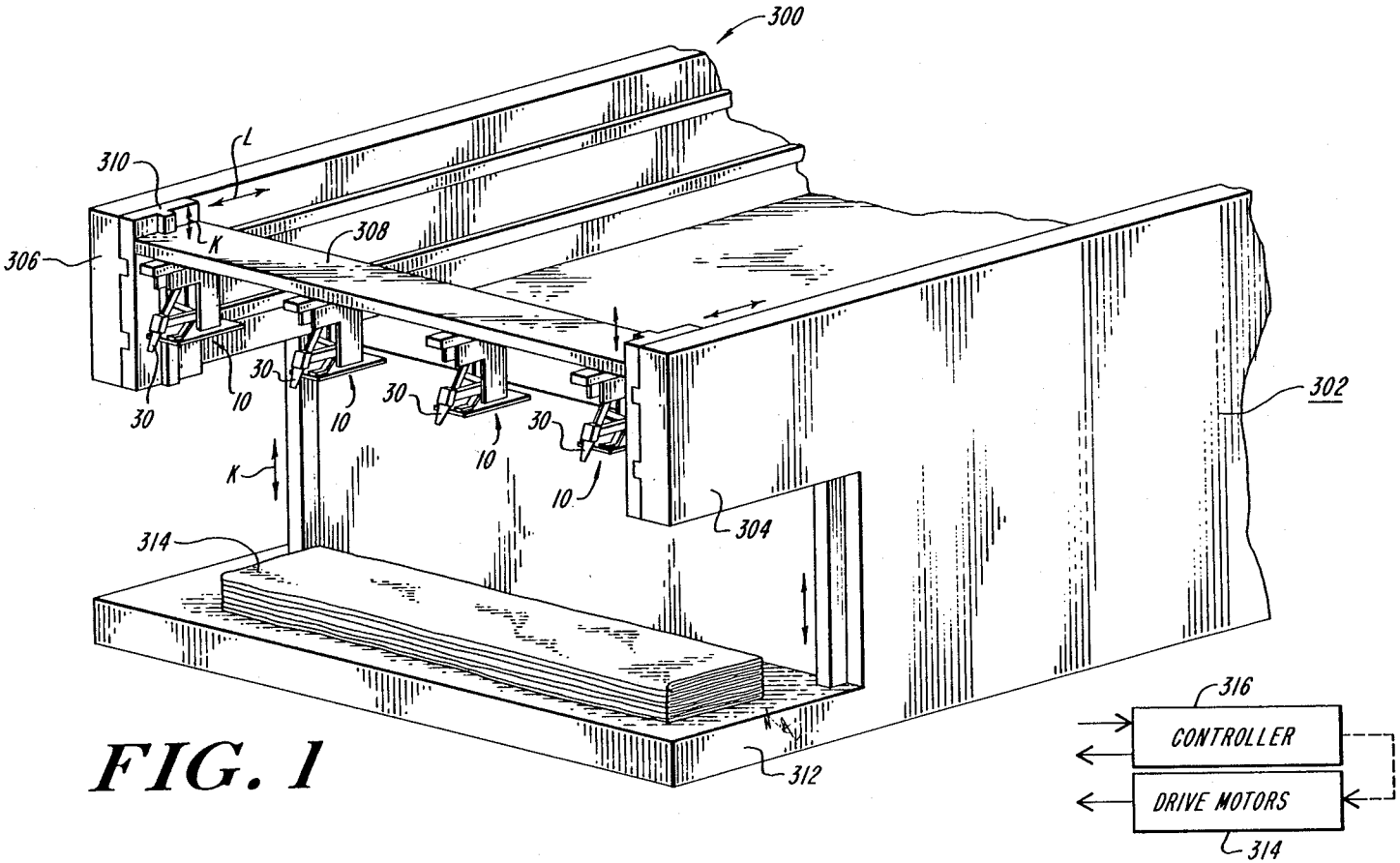
FIG. 1 is a schematic representation of an automatic system showing a transport apparatus supporting a plurality of picker actuation mechanisms in accordance with the invention.

FIG. 1 shows a loading apparatus or system 300 adapted for the lifting at the top ply (or plies) of fabric from a stack 314 on a work surface or platform 312. The construction and operation of the automated system 300 and its component parts can best be understood with reference to the drawings, wherein like reference numbers designate similar features.

The illustrated loading apparatus 300 includes a housing 302 with opposing side walls 304, 306 bridged by a cross-bar 308 for mounting plurality of picker actuation mechanisms, or "PAM's" 10 in a linear array. Four PAM's are shown in FIG. 1 for manipulating and transporting relatively large fabric segments). The PAM's are disposed in side-by-side spaced relation along the cross-bar 308, and each PAM includes a picker 30 at its distal tip. The cross-bar 308 is mounted for translation in a vertical direction indicated by arrows K in a tongue-in-groove arrangement on slidable member 310 which itself is mounted in a tongue-in-groove arrangement for translation in a horizontal direction indicated by arrows L along the interior of side walls 304, 306. At one end of the housing 302, a vertically movable platform 312 is provided for holding a stack 314 of limp material at a selected height. Movement of the cross-bar 308, member 310 and platform 312 is effected by known means, such as motors 314 controlled by the controller 316. The structure and operation of the motors 314 will be familiar to one skilled in the art, and no further description need be provided herein.

The illustrated loading apparatus 300 is adapted to transport the PAM's 10 in rectilinear fashion from the platform 312, which can be considered as a first work station to a second work station (not shown) horizontally displaced in the direction from the illustrated position of cross-bar 308. The stack 314 may be manually placed on the platform 312, and the PAM's operated preferrably in synchronization to grab and hold the uppermost segment (or segments) of limp material for transport by the loading apparatus to the second work station. The operation of the component portions of the PAM's 10 as well as the loading apparatus 300 is controlled in any desired sequence by the controller 316. The Programming of the controller 316 depends on the particular application and is well within the skill of one in the art.

Figure 2:
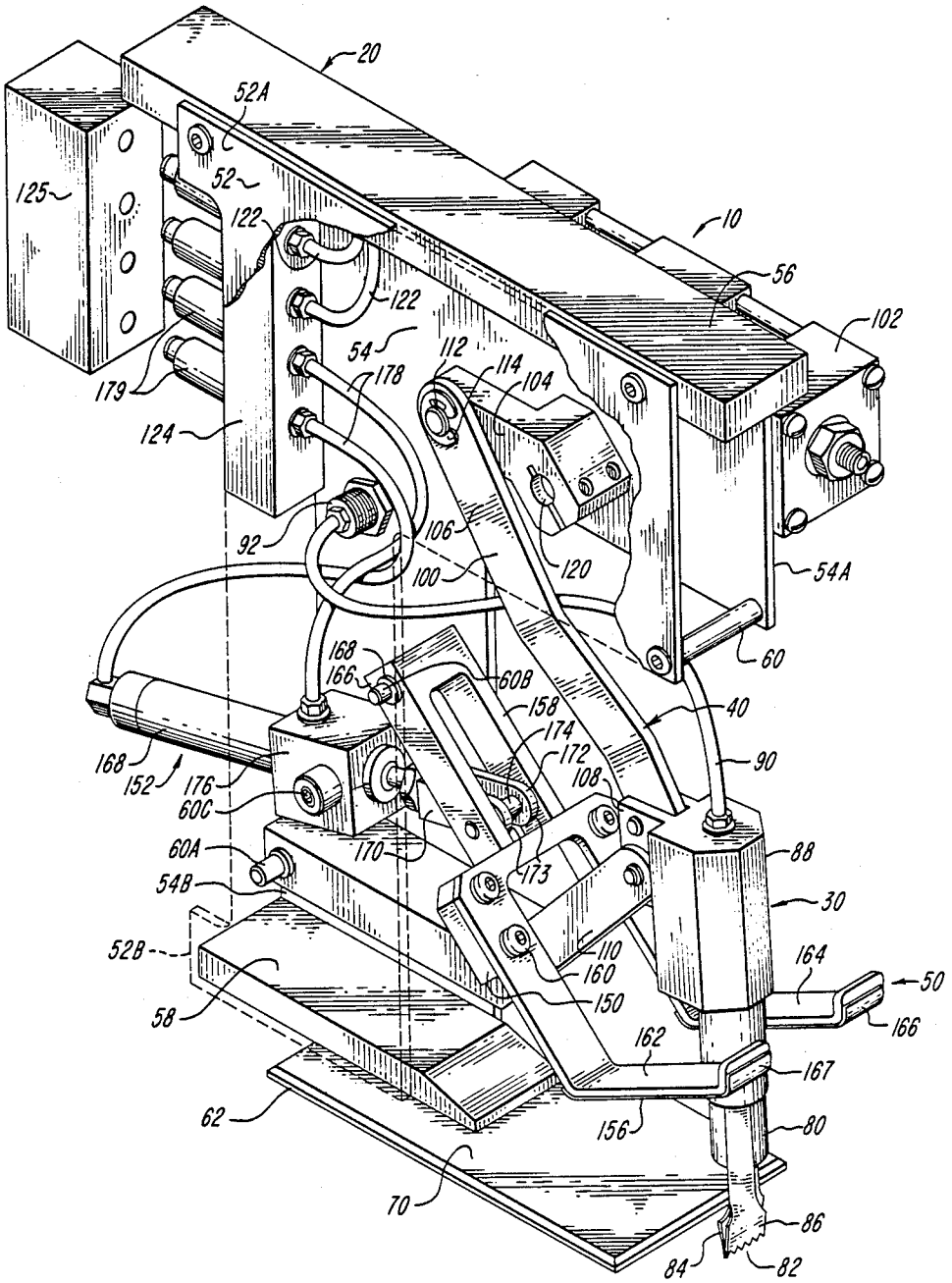
FIG. 2 is a perspective view of a picker actuation mechanism in accordance with the invention.

The PAM's 10 are central to the operation of automated system 300 for manipulating limp material segments. FIG. 2 shows a perspective view of the principal elements of a PAM 10 in accordance with the invention. The PAM 10 has a substantially rigid frame or body 20, a picker 30 for picking-up and holding an uppermost segment from a stack of limp material segments, a picker positioning assembly 40 for supporting and positioning the picker 30 with respect to the body 20, and a clamp assembly 50 for receiving the selected segment from the picker 30, and for clamping and holding the selected segment for movement with the body 20.

As described in detail below, the PAM 10 has a grasp/release assembly ("end effector") 80 at its distal tip, an associated clamp assembly 50, and a base plate 62. Each end effector is adapted to selectively grasp or release the surface of an adjacent limp material segment. In the preferred form, the selective grasping and releasing is achieved in response to a grasp/release signal applied from a controller 316 (such as a programmed digital computer). The picker positioning assembly 40 constrains the position of the end effector 80 to be in a path between a segment pick up position (laterally displaced from the base plate 62) and a segment release position (adjacent to a clamp surface of the base plate 62), as driven by an actuator in response to a pick-up control signal from controller 316. Each clamp assembly 50 is adapted to hold or release a segment of limp material that has been presented by its associated end effector, in response to a clamp/release signal applied from controller 316.

As shown in FIG. 2, the illustrated body 20 of the PAM 10 is of a generally C-shaped configuration (side view), made up of first and second spaced side plates 52, 54 extending orthogonally between elongate top and bottom members 56, 58. The side plates 52, 54 are shown as being of inverted "L" shape configuration, fixedly connected by a known expediency (e.g., screws) along a top, wider portion 52A, 54A to the top member 56 and along a bottom, narrower portion 52B, 54B to the bottom member 58. Pin-like spacers 60 bridge between and are attached to the side walls 52, 54 to provide additional structural rigidity where needed, and in some instances serve as the connection points for other parts described hereinbelow. As illustrated, projecting forwardly from the bottom member 58 is a substantially planar base plate 62 having a generally flat, top work-surface 70. The side plates 52, 54 with their overhanging wider ends 52A, 52B and the base plate 62 bound on three sides a generally rectangular space 63 (see FIG. 3). The space 63 provides clearance for the movement of the picker 30 and clamp 50 and the limp material being manipulated, as well as permits the operation of the picker 30 and clamp 50 to be visually followed.

A picker 30 includes an end effector 80 for manipulating the selected limp material segment. The end effector 80 is, for example, a vacuum-type suction device or opposing-jaw gripper. The illustrated gripper has a workpiece manipulating end 82 having normally closed, opposing-jaws 84, 86 extending from a picker guide housing 88. The opposing-jaws 84, 86, (shown in this view in their closed position), can be separated to their open position upon actuation. This is accomplished pneumatically by air introduced over flexible tubing 90 which extends from the housing 88 to a pneumatic fitting 92 secured to the body 20 for coupling the tubing 90 to a controlled Pneumatic source (not shown).

The picker positioning assembly 40 supports and moves the end effector 80 between a variety of positions, particularly with reference to the work-surface 70. The picker positioning assembly 40 includes a linkage arrangement 100 disposed generally between the side walls 52, 54 and a rotary actuator 102. The picker 30 is suspended from (with all its weight carried by) the linkage arrangement 100.

The linkage arrangement 100 is illustrated as a "closed four bar linkage system, i.e., a system of three serially arranged mechanical links articulated one-to-the-next with the first and last in the series being pivotally secured to the body 20 of the PAM 10. The picker 30 is attached along the series, intermediate its length, at locations distal from the body 20 and connected thereto by two serially arranged pivotable joints.

More specifically, the illustrated linkage arrangement 100 includes a first substantially rigid link 104 connected at a first end to the rotary actuator 102, a second substantially rigid link formed by rigidly coupled member 106 and member 108 connected between a second end of the first link 104 and a third substantially link 110 pivotally connected at a first end thereof to the member 108 and at a second end thereof to the PAM's body 20. The member 108 is illustrated as being a pair of spaced apart, opposed flanges projecting from the picker housing 88. Each of the connections between the first, second and third links is effected by associated pivot pins on which the links are secured by snap rings. The link 110 is secured to the PAM body 20 by being journaled for pivotal movement on spacer 60A. The rigid body member forms the fourth link between links 104 and 110.

The illustrated actuator 102 is a pneumatic, rotary actuator mounted on the exterior of the PAM side wall 54 along its wider portion 54A. The actuator 102 drives a rotary shaft 120 which extends through the side wall 54. The first link 104 is securely clamped on the rotary shaft 120. The arrangement by which this is achieved includes a slotted, shaft-receiving bore and set screws which, as they are turned, adjust the diameter of the bore through flexure of the surrounding material of the first link 104, so as to clamp on and angularly fix therein the received shaft 120. Flexible tubing 122 pneumatically connects the actuator 102 to a manifold block 124 provided with a plurality of pneumatic fittings 126 for coupling the flexible tubing 122 to a controlled pneumatic source 125. The illustrated manifold block 124 is disposed between the PAM side walls 52, 54.

The PAM clamp assembly 50 is adapted to cooperate with the PAM body 20 to clamp and hold a selected segment of limp material supplied to a clamping location by the picker 30. The clamp assembly 50 includes a clamping member 150 pivotally connected to the body 20, and an actuator 152 for selectively moving the clamp member 150.

The movable clamp member 150 includes a bifurcated jaw portion (called a "clamp foot") 156 which is supported in cantilever fashion at one end of a mounting Portion (called a "clamp arm") 158. The connection between the clamp foot 156 and clamp arm 158 is effected by screws 160 (or other known expediencies) which, as illustrated, join overlapping U-shaped portions of each. As the clamp foot 156 projects from the connection area, the clamping foot divides into two spaced and bended, elongate elements 162, 164 having friction pads 166, 167 on their underneath side. The clamping arm 158 is connected at its other end between the side plates 52, 54. The connection is effected by means of journalling the clamping arm 158 on a spacer 60B for relative pivotal movement. A flanged bushing is interposed between the side plates 52, 54 and the clamp arm 158 to reduce friction and wear.

The illustrated actuator 152 is a linear pneumatic actuator, having an air cylinder 168 and a piston-plunger 170 which is disposed for reciprocating linear motion relative to the air cylinder 168. The free end 172 of the piston-plunger is pivotally connected to the clamp arm 158. The illustrated connection is effected by having the clamp arm 158 formed as a yoke with parallel, spaced members 173 bridged by a transverse pin 174 on which the free end 172 is journaled. The connection to the piston-plunger 170 is made Preferably immediately above the clamp foot 156 and in spaced relation to the connection between the clamp arm 158 and the side plates 52, 54 of the body 20.

The actuator 152 further includes a mounting pivotally connecting the air cylinder 168 to the body 20. The mounting block 176 is fixedly secured to the air cylinder 168. The connection to the body 20 is effected by journalling the mounting block 176 on spacer 60C. Flexible tubing 178 pneumatically connects the actuator 152 to the manifold block 124. The manifold block 124 has a plurality of additional pneumatic fittings 179 for coupling the flexible tubing 178 to controlled Pneumatic source 125.

With this configuration, on actuation of the actuator 152, the clamp member 120 swings about spacer 60B, moving the clamp member 150 with respect to the work-surface 50 between open and closed positions.

In use, the picker 30, picker positioning assembly 40 and clamp assembly 50 cooperate to pick-up and otherwise manipulate limp fabric. The PAM's operation shall now be described with reference to FIGS. 3 through 5, in which selected positions of the picker 30 and clamp member 150 are illustrated.

Figure 3:
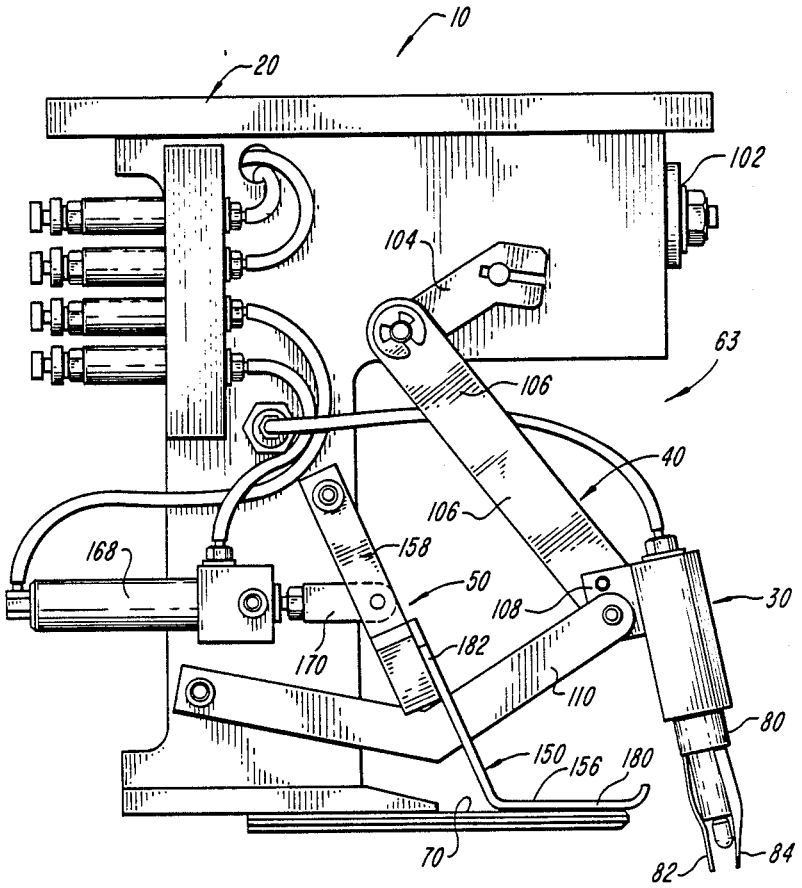
FIGS. 3 through 5 are left side elevational views of the picker actuation mechanism of FIG. 1 with the picker disposed in different positions.

In FIG. 3 the end effector 80 is shown in a fabric pick-up position, with the opposing-jaws 84, 86 in the open position ready to grab a segment of fabric or other limp material. In the fabric pick-up position, the linkage arrangement 102 of the picker positioning assembly 40 is in a fully extended state with the first link 104 rotated counter-clockwise by the actuator 102, to an angular position below the horizontal, for example, approximately one hundred thirty degrees from the vertical. In this state, the weight of the picker 30 is both suspended from second link 106 which is loaded in tension, and supported from underneath by link 110. The clamp member 150 is shown in its clamping position, with forward, padded, planar portions 180 of the elongate elements 162, 164 (see FIG. 2) horizontally flat against the work-surface 70, and connecting portion 182 of the elongate elements 162, 164 oriented generally co-linear with the clamp arm 158 at an angle of approximately thirty to forty five degrees from the vertical. The shape and relationship of the link 110 relative to the clamp member 150 enable each to move without interfering with the other. As shown, the link 110 is bent intermediate its length so as to dip below and clear the U-shaped connection of the clamp foot 156 to clamp arm 158 and extend between the elongate members 162, 164. The air cylinder 168 is oriented generally horizontally, with the piston-plunger 170 retracted.

Figure 4:
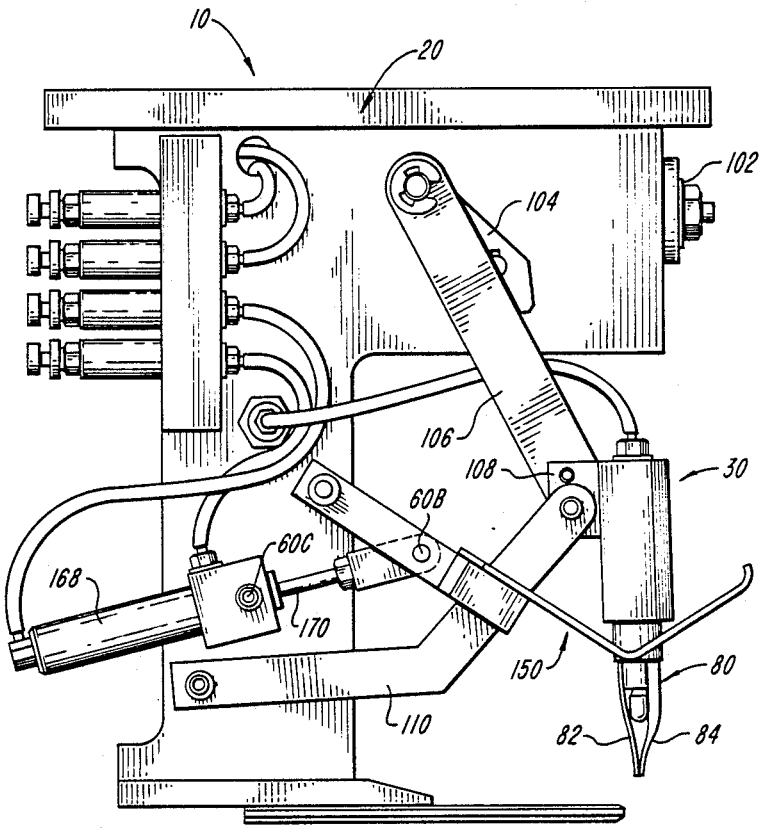

In FIG. 4, the picker 30 is shown in an intermediate position, the actuator 102 having caused the linkage arrangement 102 to move the end effector 80 up, to an orientation and position which is angularly more vertical and rearward within the body 20. At the same time, actuator 152 has caused the movable clamp member 150 to move angularly up such that the elongate elements 162, 164 (see FIG. 2) are in spaced relation to the work-surface 70 and extend on either side of the picker 30. As is apparent in comparing FIGS. 3 and 4, the moving of the clamp member 150 to this position is achieved by extending the piston-plunger 170, which causes the clamp member 150 to swing about the spacer 60B. Concurrently, the air cylinder 168 pivots counter-clockwise about spacer 60C. In this position the clamp member 150 is ready to receive material segments from the picker 30. The opposing-jaws 84, 86 of the picker 30 are shown as closed.

Figure 5:
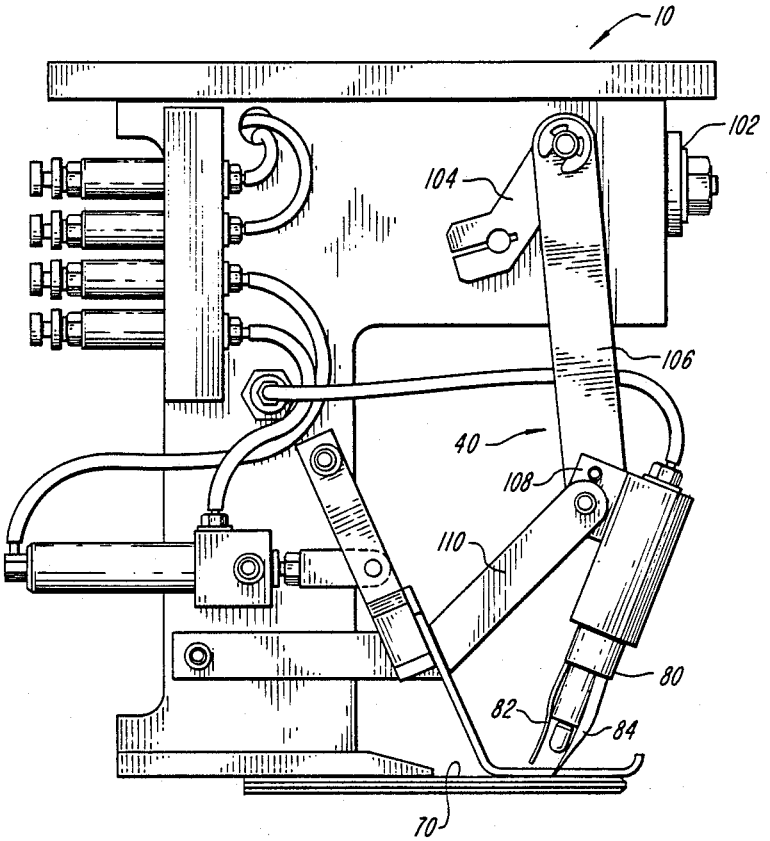

In FIG. 5, the end effector 80 is shown in a segment release position wherein the end effector 80 is disposed proximate or, preferrably, on the work-surface 70, with the opposing-jaws 84, 86 open. In the segment release position the linkage arrangement 102 of the picker positioning assembly 40 is in a fully retracted state with the first link 104 rotated clockwise by the actuator 102 upwardly and over-centered to an angle of approximately forty five degrees from the vertical. Meanwhile, the clamp member 150 as been returned to a clamping position as described above for FIG. 3.

Preferrably the operation of the picker 30, the picker positioning assembly 40 and the clamp assembly 50 is effected independently of one another for greatest system flexibility. Each can be actuated simultaneously, or sequentially. An exemplary sequence of manipulating limp material by the PAM 10 is shown schematically in FIGS. 6A through 6K. The illustrated sequence provides a way of picking-up a segment (which in this case, consists of two plies) from a stack of limp material plies located at a first work station, and dropping them upside down at a second work station. Of course, other sequences can be accomplished to satisfy diverse application-specific requirements, for example, right-side-up drop-off can be programmed. Also, any reasonable number of plies can be accommodated.

Figure 6A:
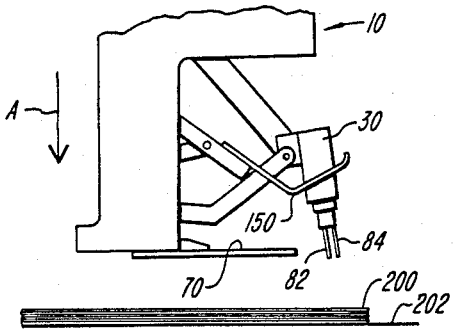
FIGS. 6A through 6K are schematic representations of the picker actuation mechanism of FIG. 2 during various steps of its operation.
Figure 6B:
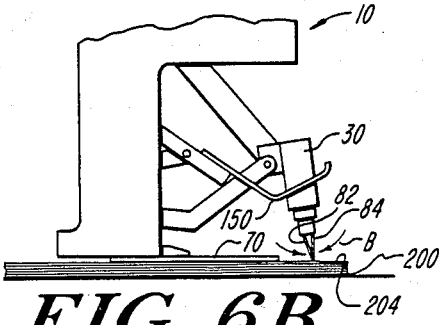
Figure 6C:
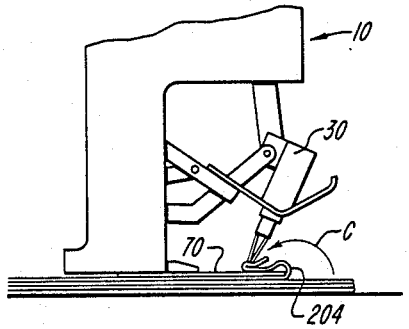
Figure 6D:
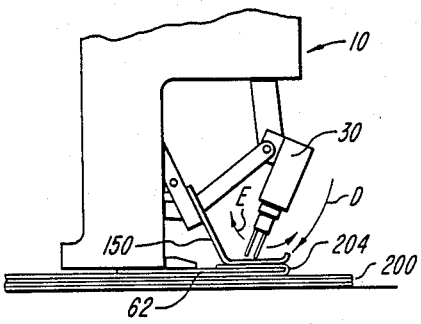

In FIG. 6A, the PAM 10 is being lowered in the direction of arrow A onto a stack 200 of limp material, e.g., fabric, located at a first work station 202. The picker 30 is in its segment pick-up position with the opposing-jaws 84, 86 open. The clamp member 150 is spaced from the work-surface 70, i.e., in the segment receiving position. In FIG. 6B, the PAM base plate 62 is resting on the stack 200 and the opposing-jaws 84, 86 are closing, as indicated by arrows B, to grab the top-most ply 204 from the stack 200 near one edge thereof. In FIG. 6C, the picker 30 is moving along an arcuate track as indicated by arrow C to deliver the selected ply 204 to the PAM work-surface 70. Note that the selected Ply 204 is placed on the work-surface in a folded-over, upside-down condition, forming an "S" shape where held by the picker 30, as shown. In FIG. 6D the clamp member 150 swings down as indicated by arrow D to clamp the selected ply 204 to the work surface in the upside-down condition. Thus, the edge of the selected ply is folded over the base plate 62 and clamped to the PAM 10. The picker 30 is simultaneously or consecutively opened (arrows E) to release the selected ply 204. At this stage the selected ply 204 could, if desired, be removed from the stack 200.

Figure 6E:
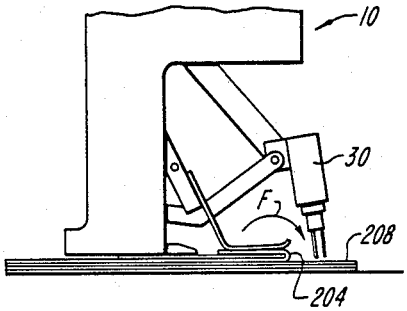
Figure 6F:
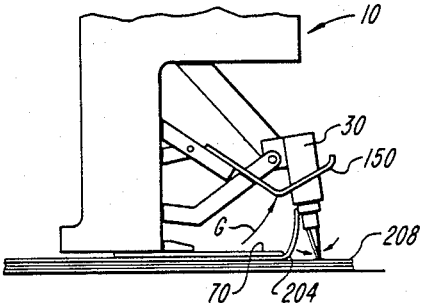
Figure 6G:
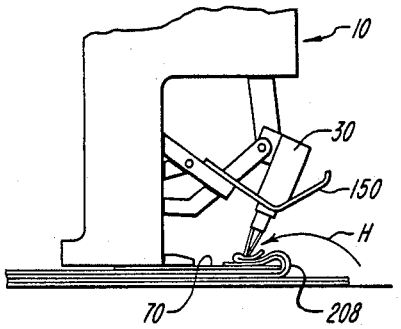
Figure 6H:
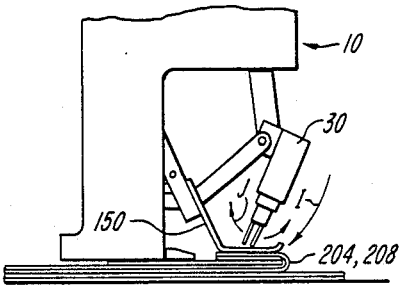

However, the versatility of the PAM 10 can be demonstrated by the PAM 10 manipulating a second ply, as shown in FIGS. 6E through 6H. In FIG. 6E, the picker 30 moves as indicated by arrow F to obtain a second ply 208 from the stack 200, the ply immediately below the first ply 204. As shown in FIG. 6F, after the picker 30 has grabbed the second Ply 208 and has proceeded part way towards the segment release position, the clamp member 150 is raised, as indicated by arrow G. The folded over edge of the first ply 204, if sufficiently limp, will stay in position on the work surface 70, or, if not, will attempt to return to the stack only to be stopped by contacting the exterior of the picker 30, as shown. The picker 30 will then proceed to push the first ply 204 back to the work-surface 70 (arrow H) and deposit the second ply 208 over the first, likewise in a folded-over condition, as shown in FIG. 6G. In FIG. 6H, the clamp member 150 is swinging down (arrow I) to clamp both plies 204, 208 in sandwich fashion while the picker 30 opens (arrows J).

Figure 6I:
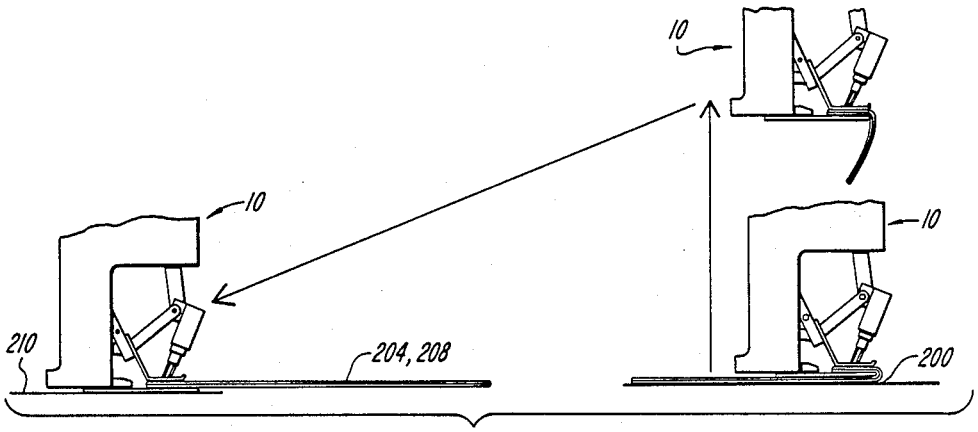
Figure 6J:
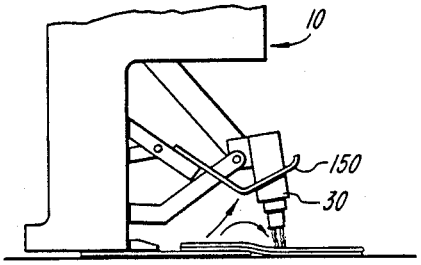
Figure 6K:
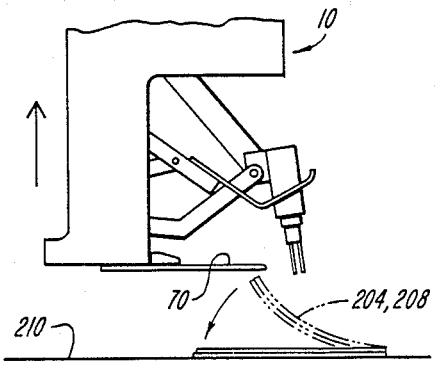

The PAM 10, while holding the first and second plies 204, 208 can then be moved to any desired location, such as a second work station which is displaced along a horizontal axis (i.e. in the direction "L" as shown in FIG. 1). In FIG. 6I the PAM 10 is shown on the right as it is being removed from the stack 200 (bottom illustration) to a position vertically over the stack (top illustration). The PAM 10 continues to hold the edge of the first and second plies 204, 208, which tend to unfold as the PAM 10 moves up. On the left side of FIG. 6I the PAM 10 has been translated to the second work station 210, and in so doing has placed the selected plies 204, 208 upside down thereon. It will be apparent that if the PAM had been translated in the opposite direction, i.e., left to right, the selected plies 204, 208 could have been placed right-side-up. In FIG. 6J, the clamp member 150 is lifted as indicated by arrow G, and the picker 30 moved out of the way, so that, as shown in FIG. 6K, the PAM 10 can be raised from the second work station 210. As the PAM 10 is removed, the selected plies 204, 208 fall from the PAM work-surface 70 onto the work station 210.

While the above description is directed to a single PAM 10, all of the PAM's affixed to cross-bar 308 in the system 300 of FIG. 1 may be similarly operated in tandem so that selectively large limp material segments may be lifted and manipulated from Platform 312. After being transported along to another horizontal axis work station in this manner, the segment (or segments) may be assembled into a garment for example using the automated article assembly techniques disclosed in the above referenced Patents.

Further, while the above description is in the context of a multiple ply stack on a support 312, in other forms, the "stack" may include just a single ply. In such configurations, the present invention may readily be used to lift, transport, and similarly manipulate that single ply.

The invention can be embodied in other specific forms without departing from the spirit or essential characteristics thereof. The described embodiments of the invention are to be considered in all respects as illustrative and not restructive, the scope of the invention being indicated by the appended claims rather than the foregoing description, and all changes which come within the meaning and range of equivalency of the claims are therefore intended to be embraced therein.

What is claimed is:

1. A manipulator system for selectively manipulating the top segment of a stack of one or more limp material segments said system comprising at least one picker assembly, each picker assembly including:

A. a body having a base plate said body being movable with respect to said stack of limp material segments;

B. picker having an end effector for selectively grasping and releasing an adjacent surface of a limp material segment in response to an applied grasp-/release signal;

C. picker positioning means for Positioning said picker with respect to said body, said picker positioning means including:

i. a linkage pivotally connected between said body and said picker and constraining motion of said end effector to a path between a segment pick-up position and a segment release position, said segment pick-up position being laterally displaced from said base plate and adjacent to the top segment of said stack, and said segment release position being adjacent to a clamp surface of said base plate, and ii. first actuator means responsive to an applied pick-up control signal for selectively driving said linkage to move said end effector between said segment pick-up position, and a segment release position; and D. clamp means responsive to an applied clamp-/release signal for receiving a segment from said picker at said segment release position, and for clamping said received segment to said base plate.

2. A manipulator system according to claim 1 further comprising a controller for generating said grasp-/release signal, said pick-up control signal, and said clamp release signal.

3. A manipulator system according to claim 1 further comprising a controller including means for generating said grasp/release signal, said pick-up control signal, and said clamp/release signal to control operation of said picker, said picker positioning means, and said clamp means whereby, in succession, said end effector travels to said pick up position and grasps the top surface of said segment, said end effector transports said grasped segment to said release position, said clamp means clamps said transported segment against said base plate, and said end effector releases said clamped segment.

4. A manipulator system in accordance with claim 1 wherein said end effector includes a gripper having first and second opposing jaws, and a second actuator means for effecting relative movement of said first and second jaws between a gripping position and a release closed position.

5. A manipulator system in accordance with claim 1 wherein said base plate defines a stationary jaw of said clamp means; and wherein said clamp means further includes a moveable jaw, and a third actuator means for effecting movement of said moveable jaw with respect to said base plate between (i) a release position at which said moveable jaw is spaced from said base plate, and (ii) a clamp position at which said moveable jaw is proximate to said base plate, said clamp means being operable independent of said picker.

6. A manipulator system of claim 5 wherein said third actuator means includes a linear actuator pivotally connected to said body.

7. A manipulator system of claim 1 wherein said linkage is a multi-bar articulated linkage and includes i. a rotary actuator affixed to said body at a first location, ii. a first substantially rigid link drivingly connected at a first end to said rotary actuator for angular movement of said first link with respect to said body, iii. a second substantially rigid link having a first end pivotally connected to a second end of said first link, and iv. a third substantially rigid link having a first end pivotally connected to a second end of said second link and having a second end pivotally connected to said body at a second location, and v. includes means for affixing said picker to said second link near the junction of said second and third links, said first and second locations being spaced apart.

8. A manipulator system according to claim 1 comprising:

A. a stack support member including a support surface for supporting said limp material segment;

B. a plurality of picker assemblies;

C. a picker support member extending along a reference axis and including means for supporting said plurality of picker assemblies in a spaced apart array with said end effectors overlying and proximate to said support surface when in said segment pick-up position, D. transport means operative in response to an applied transport control signal for selectively positioning said picker support member in a direction transverse to said reference axis.

9. A manipulator system according to claim 8 further comprising means operative in response to an applied platform control signal for selectively controlling the height of said support surface with respect to said picker support member.

* * * * *